US012279699B2

(12) United States Patent
Alletto, Jr.

(10) Patent No.: US 12,279,699 B2
(45) Date of Patent: Apr. 22, 2025

(54) MATTRESS TOPPER

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 1176 days.

(21) Appl. No.: 17/108,237

(22) Filed: Dec. 1, 2020

(65) Prior Publication Data

US 2021/0076833 A1 Mar. 18, 2021

Related U.S. Application Data

(63) Continuation of application No. 15/410,989, filed on Jan. 20, 2017, now Pat. No. 10,849,435.

(60) Provisional application No. 62/281,493, filed on Jan. 21, 2016.

(51) Int. Cl.

| | |
|---|---|
| ***A47C 27/00*** | (2006.01) |
| ***A47C 21/04*** | (2006.01) |
| ***A47C 27/22*** | (2006.01) |
| ***A47C 31/10*** | (2006.01) |
| ***A47G 9/02*** | (2006.01) |

(52) U.S. Cl.

CPC ..... *A47C 27/006* (2013.01); *A47C 21/046* (2013.01); *A47C 27/002* (2013.01); *A47C 27/003* (2013.01); *A47C 27/005* (2013.01); *A47C 27/22* (2013.01); *A47C 31/105* (2013.01); *A47G 9/0215* (2013.01)

(58) Field of Classification Search

CPC ... A47C 27/002; A47C 27/003; A47C 27/005; A47C 27/006; A47C 27/007; A47C 27/22; A47C 21/04; A47C 21/046; A47C 21/06; A47C 31/10; A47C 31/105; A47G 9/02; A47G 9/0207; A47G 9/0215; A47G 9/0223

USPC ..... 5/500, 691

See application file for complete search history.

(56) References Cited

U.S. PATENT DOCUMENTS

| | | | | | |
|---|---|---|---|---|---|
| 1,533,973 | A * | 4/1925 | Cohen | A61F 13/00 | 297/DIG. 5 |
| 2,660,735 | A * | 12/1953 | Baum | A47C 27/127 | 5/699 |
| 4,961,238 | A * | 10/1990 | Limb | A47G 9/0207 | 442/373 |
| 5,117,519 | A * | 6/1992 | Thomas | A47C 27/05 | 112/475.08 |
| 5,398,355 | A * | 3/1995 | Bailey | B32B 5/245 | 5/500 |
| 6,163,907 | A * | 12/2000 | Larson | A47C 21/048 | 5/691 |
| 6,174,584 | B1 * | 1/2001 | Keller | A47C 27/006 | 428/76 |

(Continued)

*Primary Examiner* — David R Hare

(74) *Attorney, Agent, or Firm* — Sorell, Lenna & Schmidt, LLP

(57) ABSTRACT

A mattress topper is provided that includes a cover having opposing first and second panels each made from a first material. The mattress topper includes a gusset that either perimetrically joins the first and second panels and/or is in the form of one or more patches located on the first and/or second panels. The gusset is made from a second material that has a porosity that is different than that of the first material. A fill material is disposed within the cover.

18 Claims, 8 Drawing Sheets

(56) References Cited

U.S. PATENT DOCUMENTS

| | | | | |
|---|---|---|---|---|
| 6,263,532 | B1 * | 7/2001 | Miller | A47C 31/105 5/737 |
| 6,393,640 | B1 * | 5/2002 | Dalis | A47C 31/105 5/655.5 |
| 6,618,881 | B2 * | 9/2003 | Hart | A47G 9/0207 5/482 |
| 6,715,173 | B2 * | 4/2004 | Barman | A47C 31/105 5/691 |
| 6,745,419 | B1 * | 6/2004 | Delfs | A47G 9/0207 5/691 |
| 6,922,862 | B1 * | 8/2005 | Thompson | A47C 27/005 5/691 |
| 8,464,657 | B1 * | 6/2013 | King | A01K 1/0353 119/28.5 |
| 8,512,854 | B2 * | 8/2013 | Fox | B32B 5/245 428/319.3 |
| 8,707,482 | B1 * | 4/2014 | Ramthun | A47C 31/105 5/500 |
| 2004/0216237 | A1 * | 11/2004 | Metzger | A47C 31/105 5/691 |
| 2007/0174962 | A1 * | 8/2007 | Smith | A47C 27/006 5/691 |
| 2011/0072591 | A1 * | 3/2011 | Fang | A47C 31/105 5/737 |
| 2016/0192786 | A1 * | 7/2016 | Holbrook | A47C 27/085 5/691 |

* cited by examiner

MATTRESS TOPPER

CROSS-REFERENCE TO RELATED APPLICATIONS

This application is a continuation application of U.S. patent application Ser. No. 15/410,989, filed Jan. 20, 2017, which claims priority from Provisional Application 62/281,493, filed Jan. 21, 2016 which is incorporated by reference herein, in its entirety.

TECHNICAL FIELD

The present disclosure generally relates to bedding, and more particularly to mattress toppers adapted to provide added comfort and ventilation to prevent heat buildup between a sleep surface and a mattress.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

Typically, a bed sheet is positioned on top of a mattress and one or more sleepers rest their body(ies) on top of the bed sheet. While the mattress may provide some degree of comfort, conventional mattresses often do not have enough cushioning to allow for restful sleep. That is, due to the lack of adequate cushioning, the sleeper's body weight causes him or her to contact hard surfaces of the mattress, such as, for example, springs, wood, plastic, etc., which often times will prevent restful sleep.

Furthermore, when a sleeper rests his or her body on top of a bed sheet, heat from the sleeper's body radiates through the bed sheet to the mattress below the bed sheet. In that conventional mattresses do not allow any means to allow the heat between the mattress and the bed sheet to escape, the heat remains trapped between the bed sheet and the mattress. The heat that is trapped between the mattress and the bed sheet will then radiate back through the bed sheet to the sleep surface of the bed sheet, thus causing the temperature of the sleep surface to increase, which often results in discomfort and further prevents restful sleep. This disclosure describes an improvement over these prior art technologies.

SUMMARY

In one embodiment, in accordance with the principles of the present disclosure, a mattress topper is provided. The mattress topper is configured to be positioned between a mattress and a bed sheet that is positioned over the mattress and the mattress topper. The mattress topper includes a cover having opposing first and second panels each comprising a first material. The mattress topper further includes a gusset perimetrically bounding and joining the first and second panels. The gusset comprises a second material that has a porosity that is different than that of the first material. In some embodiments, a fill material is disposed within the cover.

In one embodiment, in accordance with the principle of the present in disclosure, the mattress toper can have a stylized gusset in the form of patches, conjoined patches, and/or various geometrically shaped gussets in addition to the perimetrically bounding gusset or instead of the perimetrically bounding gusset. The stylized gusset patches can be located on one side or both sides of the mattress topper.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
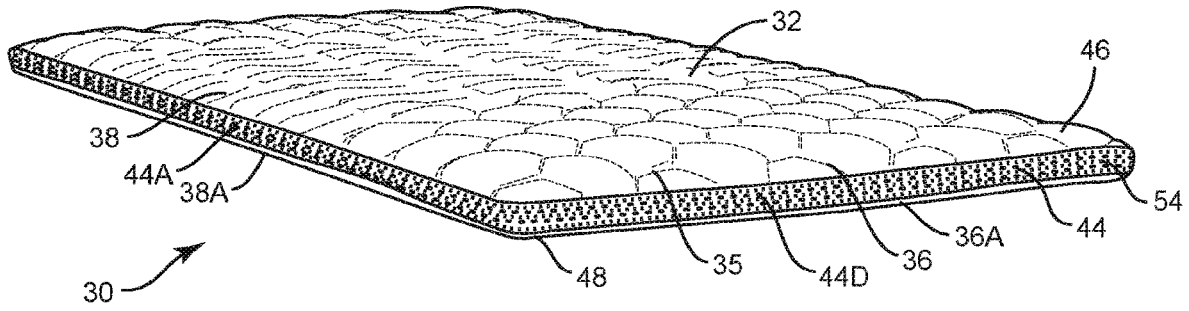
FIG. 1 is a perspective view of one embodiment of a mattress topper in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a mattress topper in accordance with the principles of the present disclosure. Alternate embodiments are also disclosed. Reference will now be made in detail to the exemplary embodiments of the present disclosure, which are illustrated in the accompanying figures. Turning to FIGS. 1-12, there are illustrated components of a mattress topper 30.

Mattress topper 30 includes various surface fabrics and interior fills that are designed to allow air from a sleeper's body circulate through mattress topper 30 such that air from the sleeper's body moves into and out of mattress topper 30. In some embodiments, mattress topper 30 is configured to allow ambient air to enter an inner cavity of mattress topper 30 after air from the sleeper's body exits mattress topper 30, as discussed herein.

Mattress topper 30 includes a top surface, such as, for example, a panel 32. Panel 32 comprises an end surface 34 and an opposite end surface 36. Surfaces 34, 36 extend between opposite side surfaces 38, 40. Surfaces 34, 36, 38 and 40 are edges of panel 32 that define a perimeter of panel 32. In some embodiments, surface 34 may be disposed at alternate orientations relative to surface 36, such as, for example, parallel, transverse, and/or other angular orientations such as acute or obtuse, tapered, and/or may be offset or staggered. Likewise, in some embodiments, surface 38 may be disposed at alternate orientations relative to surface 40, such as, for example, parallel, transverse, and/or other angular orientations such as acute or obtuse, tapered, and/or may be offset or staggered to form various shaped toppers.

Mattress topper 30 includes a panel 32A opposite panel 32. Panel 32A comprises an end surface 34A and an opposite end surface 36A. Surfaces 34A, 36A extend between opposite side surfaces 38A, 40A. Surfaces 34A, 36A, 38A and 40A are edges of panel 32A that define a perimeter of panel 32A. In some embodiments, surface 34A may be disposed at alternate orientations relative to surface 36A. Likewise, in some embodiments, surface 38A may be disposed at alternate orientations relative to surface 40A to provided variously shaped mattress toppers.

In some embodiments, panels 32, 32A each have a rectangular or substantially rectangular footprint. In some embodiments, panel 32 and/or panel 32A may have various cross section configurations or footprints, such as, for example, oval, oblong, triangular, rectangular, square, polygonal, or irregular. In some embodiments, panels 32, 32A are parallel to one another.

Panels 32, 32A are each made from a first material. In some embodiments, the first material comprises a porous base material. In some embodiments, the first material comprises pores that are defined by fibers or strands of the first material, such as, for example, a fabric that makes up the first material. That is, the pores of the first material are the spaces between the fibers or strands of the first material. In some embodiments, the pores have a random configuration (size, shape and/or spacing) that is determined by the arrangement of the fibers or strands of the first material. In some embodiments, the first material has pores that are evenly spaced apart from one another. In some embodiments, the pores are variously shaped, such as, for example, oval, oblong, triangular, square, polygonal, irregular, uniform, non-uniform, offset, staggered, undulating, arcuate, variable and/or tapered.

In some embodiments, panels 32, 32A each include a single layer of material, such as, for example, fabric. That is, the first material may include a single layer of material or fabric. In some embodiments, panels 32, 32A each include multiple layers of material, such as, for example, fabric. In some embodiments, panel 32 includes three layers, wherein a first outer layer comprises a heat and moisture wicking fabric that may also have a cool or warm touch feel. The second inner layer opposite the first outer layer includes a filter fabric to reduce the passage of loose fibers or other small objects, including allergens such as dust and pet dander from the environment, into an interior of mattress topper 30, without preventing air flow through panel 32. The third layer between the first and second layers that includes a material that provides cushioning and support, additional insulation or ventilation, for example a fill.

In some embodiments, the first material is a moisture dispersing material. In some embodiments, the first material is a breathable material, such as, for example a ventilated or breathable fabric that allows airflow. In some embodiments, the first layer may comprise Dri-Tec®, Ver-Tex®, polyester, 100% polyester, polyester and polyethylene, nylon, and/or materials or materials selected form the group consisting of acrylic, acetate, cotton, linen, silk, polyester, wool, nylon, rayon, spandex, lycra, hemp, manmade materials, natural materials (e.g., hemp) and blends thereof. Particular materials or blends of materials used are selected according the particular characteristics, price point, durability, and appearance to be achieved.

A temperature-adjustment material, such as a gel that cools or a thermo-electric device that heats or cools, may be applied interiorly to panel 32 and/or panel 32A. The cooling material may be silicon or polyether gel formed into layers and applied shapes, as well as, formed ceramics, electric devices, neoprene and other material technology for use to perform heat transfer and temperature regulation function. Depending on the nature and stability of the temperature-regulating material, the material may be internally applied and/or externally to panel 32 and/or panel 32A.

In some embodiments, panels 32, 32A each include a single layer of fabric. That is, the first material that panel 32 is made from may include a single layer of fabric and the first material that panel 32A is made from may include a single layer of fabric. In some embodiments, panels 32, 32A each include multiple layers of fabric. That is, the first material that panel 32 is made from may include a multiple layers of fabric and the first material that panel 32A is made from may include multiple layers of fabrics. In some embodiments, at least one of panels 32, 32A may include a water resistant or waterproof finish or material. That is, an outer surface of at least one of panels 32, 32A may include a water resistant or waterproof finish or material that prevents water and/or other liquids from entering an interior cavity of mattress topper and/or penetrating into panel 32 or panel 32A. In some embodiments, the water resistant or waterproof finish or material is gas permeable to allow air to move through mattress topper 30.

In some embodiments, the first material that forms panel 32 includes multiple layers of fabric and the first material that forms panel 32A includes a single layer of fabric. In some embodiments, the multiple layers of fabric that make up panel 32 are stitched together. That is, panel 32 includes one or more layers of fabric that make up a top layer of panel 32 and one or more layers of fabric that make up a bottom layer of panel 32, wherein the top layer is stitched to the bottom layer by stitching 35 to form panel 32. In some embodiments, stitching 35 reduces the profile of stitched portions of panel 32 to create different elevations of the fabric structure, so that there are highs and lows of profile that increase air circulation in around and through outer surfaces of panel 32, and between the outer surfaces of panel 32 and the sleeper.

Figure 7:
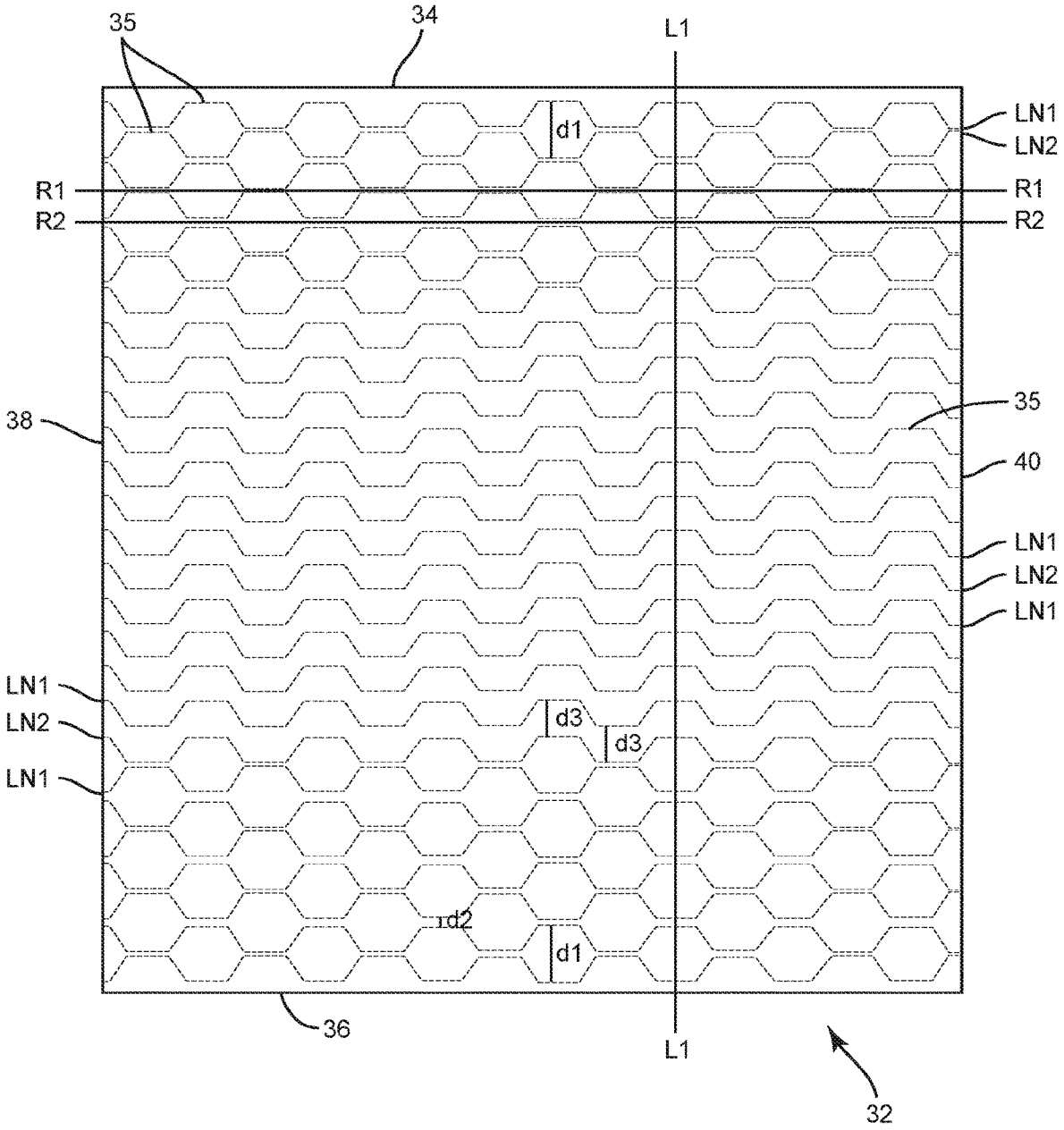
FIG. 7 is a top view of the mattress topper shown in FIG. 1.
Figure 8:
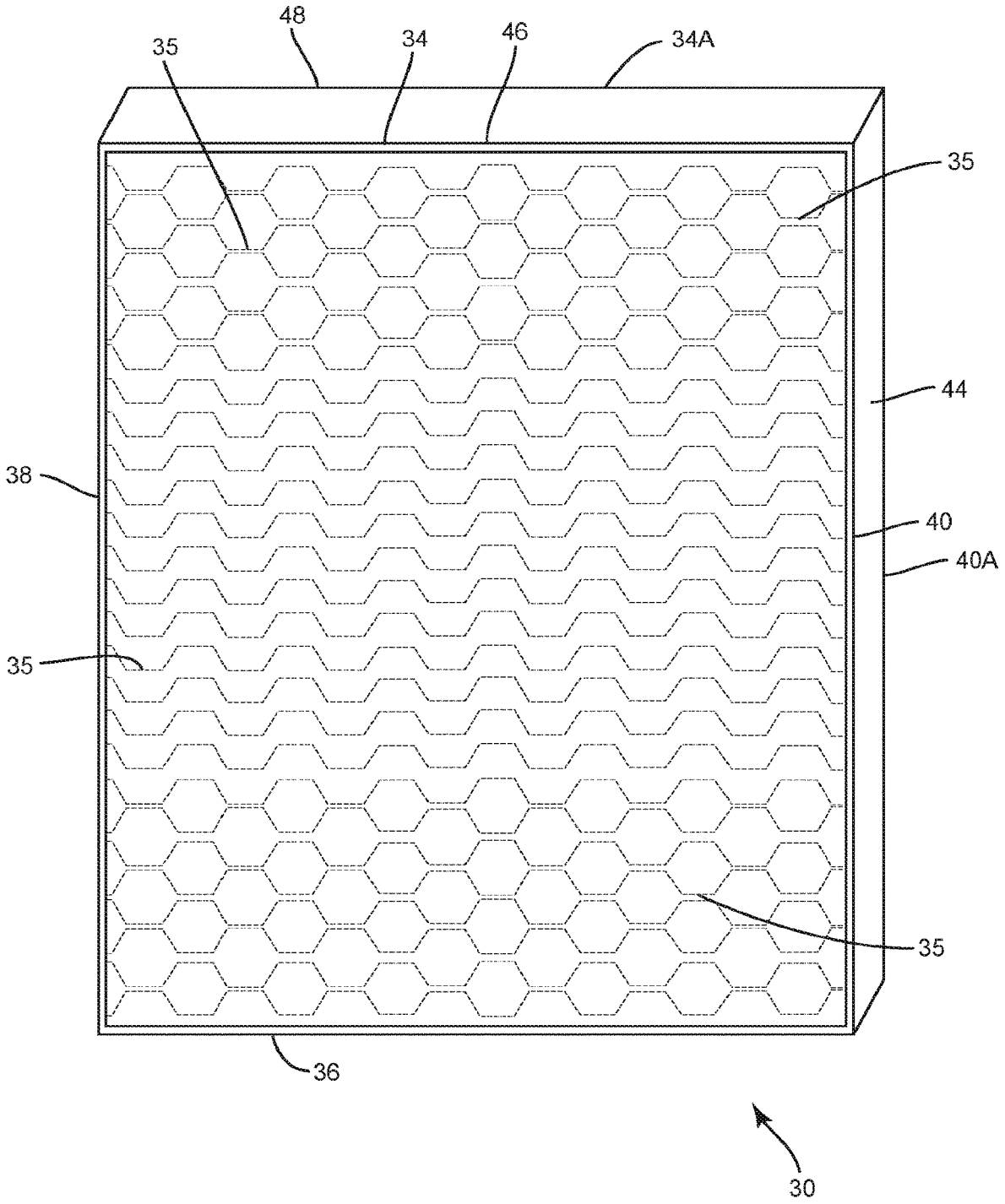
FIG. 8 is a top, perspective view of the mattress topper shown in FIG. 1.

In some embodiments, stitching 35 forms a plurality of rows each having a geometric pattern. In some embodiments, the rows alternate such that a feature of the geometric pattern in a respective row is not coaxial with the same feature of the geometric pattern of an adjacent row. That is, a geometric pattern in one of the rows, such as, for example, a hexagonal pattern in row R1 is not coaxial along longitudinal axis L1 with a hexagonal pattern in an adjacent row R2, as shown in FIG. 7, for example. In some embodiments, the rows adjacent surfaces 34, 36 form a first geometric pattern and at least one row between the rows that form the first geometric pattern form a second geometric pattern, as shown in FIGS. 1-3, 7, 8 and 10, for example. It is envisioned that stitching 35 may be used to form any pattern or combination of patterns. It has been found that the configuration of the pattern shown in FIGS. 1-3, 7, 8 and 10 wherein stitching 35 forms a first geometric patterns adjacent surfaces 34, 36 and a second geometric pattern between the first geometric patterns adjacent surfaces 34, 36 mimics a sleeper's body contours and provides for the movement of air. In some embodiments, the first geometric pattern includes a plurality of hexagons that are connected together by narrow straits. In some embodiments, the hexagons have a maximum height d1 and the straits have a maximum height d2 that is less than height d1, as shown FIG. 7. In some embodiments, height d1 is between about 1 inch and about 10 inches and height d2 is between about 0 inches and about 1 inch. In some embodiments, height d1 is about 5 inches and height d2 is about 0.72 inches. In some embodiments, the second geometric pattern is a wave-like pattern with crests and troughs. In some embodiments, the crests are spaced apart from the hexagons of the first geometric pattern by a distance d3. Likewise, the troughs are spaced apart from the straits by distance d3. In some embodiments, distance d3 is about 1 inch to about 5 inches. In some embodiments, distance d3 is about 3 inches.

The pattern shown in FIGS. 1-3, 7, 8 and 10 created by stitching 35 allows for the movement of air from left to right and from right to left (e.g., from surface 38 to surface 40 and from surface 40 to surface 38). As such, air will move laterally across a sleeper's body rather than longitudinally along his or her body. In some embodiments, panel 32 may include airflow and/or ventilation patches in the surface of panel 32 to increase the flow of air into, across, or out of panel 32. In some embodiments, the pattern formed by stitching 35 mimics the ergonomic shape of a sleeper, such as, for example, different dimensions that suggest zones of the sleeper's body, from head to shoulders to torso to leg to foot. That is, areas of mattress topper 30 that require greater airflow, such as, for example, areas that the sleeper's head and feet contact may include the first geometric pattern that includes the plurality of hexagons that are connected together by the narrow straits. Areas of mattress topper 30 that require less air flow, such as, for example, areas that the sleeper's midsection contacts may include the second geometric pattern that includes the wave-like pattern of crests and troughs. The geometric pattern of the quilting on the topper enhances and/or alters the airflow as well as provides different degrees of cushioning.

In some embodiments, mattress topper 30 may include different fill materials within mattress topper 30 and mattress topper 30 may additionally include ventilation zippers in different zones to allow for different degrees of cushioning, warmth and/or ventilation. For example, mattress topper 30 may include a plurality of zippers that are spaced apart about mattress topper 30 thereby allowing a sleeper the option to open one or more of the ventilation zippers, depending upon the desired amount of ventilation. As would be recognized by one of ordinary skill in the art, the more ventilation zippers that are opened, the quicker air can move from within mattress topper 30 to an area outside of mattress topper 30. Therefore, a sleeper can control the amount of ventilation provided by mattress topper 30 by selectively opening a desired number of ventilation zippers. For example, the sleeper can open additional ventilation zippers when increased ventilation is required.

In some embodiments, panel 32A includes stitching which is similar to or the same as stitching 35 on panel 32. In some embodiments, panel 32A includes one layer or multiple layers of fabric and is free of stitching that connects the layers of fabric. In some embodiments, panel 32 and/or panel 32A does not include stitching 35 and has a smooth or even outer surface that is free of any recesses or protrusions to reduce the feel/friction of the structure against the skin of the sleeper and in order to maximize flexibility of panel 32 to adapt to the sleeper's body curves.

In some embodiments, stitching 35 may form pockets between adjacent lines of stitching 35, such as, for example, between lines LN1 and lines LN2, as shown in FIG. 7. The pockets are closed off by additional stitching for example at surfaces 38, 40, to form a closed pocket. The pockets formed by adjacent lines of stitching 35 and the closures at surfaces 38, 40 may be used to trap heated air within the pockets, which prevents the heated air from escaping. That is, the pockets formed by adjacent lines of stitching 35 and the closures at surfaces 38, 40 prevent the heated air from moving out of mattress topper 30 and through a bed sheet positioned on top of panel 32. In this manner, heated air that is trapped within the pockets formed by adjacent lines of stitching 35 and the closures at surfaces 38, 40 will not reach the sleep surface and cause the sleep surface to increase in temperature of the sleep surface. In some embodiments, panel 32 includes one or a plurality of pockets.

In some embodiments, stitching 35 may form channels between adjacent lines of stitching 35, such as, for example, between lines LN1 and lines LN2, as shown in FIG. 7. The channels formed by adjacent lines of stitching 35 may each include open ends at surfaces 38, 40 so as not to trap heated air that enters the channels within each of the channels. That is, the channels formed by adjacent lines of stitching 35 allow the heated air to move out of mattress topper 30 through an opening in at least of each channel that extends through surface 38 and/or surface 40. This prevents the heated air from moving through a bed sheet positioned on top of panel 32. In this manner, heated air that moves into the channels formed by adjacent rows of stitching 35 will not reach the sleep surface and cause the sleep surface to increase in temperature, as discussed in greater detail herein. In some embodiments, mattress topper 20 includes one or a plurality of channels. In some embodiments, mattress topper 20 includes one or a plurality of channels and one or a plurality of pockets.

Figure 12:
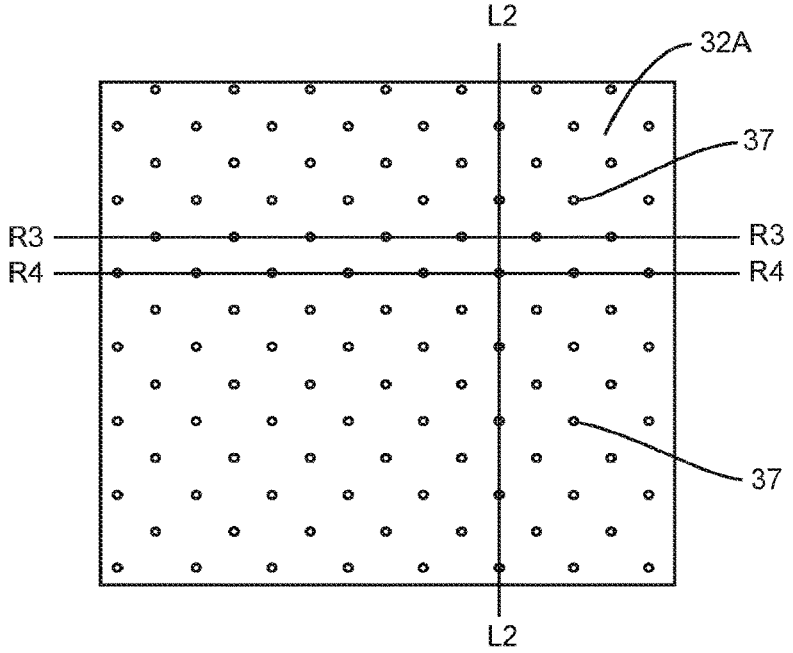
FIG. 12 is a close up bottom view of a portion of the mattress topper shown in FIG. 10.

In some embodiments, panel 32A includes features to prevent skidding. In one embodiment, the features to prevent skidding include a plurality of spaced apart bumps or protrusions 37 that extend from the outer surface of the fabric that makes up panel 32A, as shown in FIG. 12, for example. In some embodiments, bumps or protrusions 37 are made from a different type of material that the single layer of fabric panel 32A is made from. That is, bumps or protrusions 37 are not made from the first material. In some embodiments, the bumps or protrusions 37 are made from an elastomeric material, such as, for example, silicone or rubber. In some embodiments, bumps or protrusions 37 are randomly positioned on panel 32A. In some embodiments, bumps or protrusions 37 are evenly spaced apart from one another. In some embodiments, bumps or protrusions 37 are arranged to define a distinct pattern. In some embodiments, bumps or protrusions 37 are arranged in rows and columns, wherein bumps or protrusions 37 in one row are not coaxial with bumps or protrusions 37 in an adjacent row, as shown in FIG. 12, for example. That is, one of bumps or protrusions 37 in one of the rows, such as, for example, one of bumps or protrusions 37 in row R3 is not coaxial along longitudinal axis L2 with any of bumps or protrusions 37 in an adjacent row R4, as shown in FIG. 12, for example.

Figure 2:
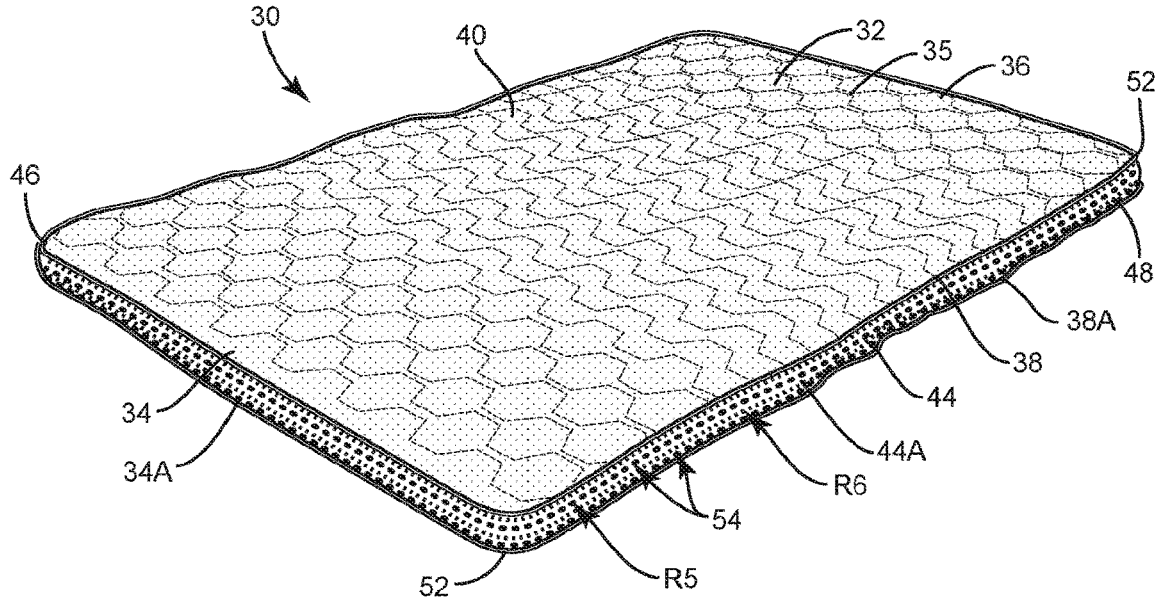
FIG. 2 is a perspective view of the mattress topper shown in FIG. 1.
Figure 3:
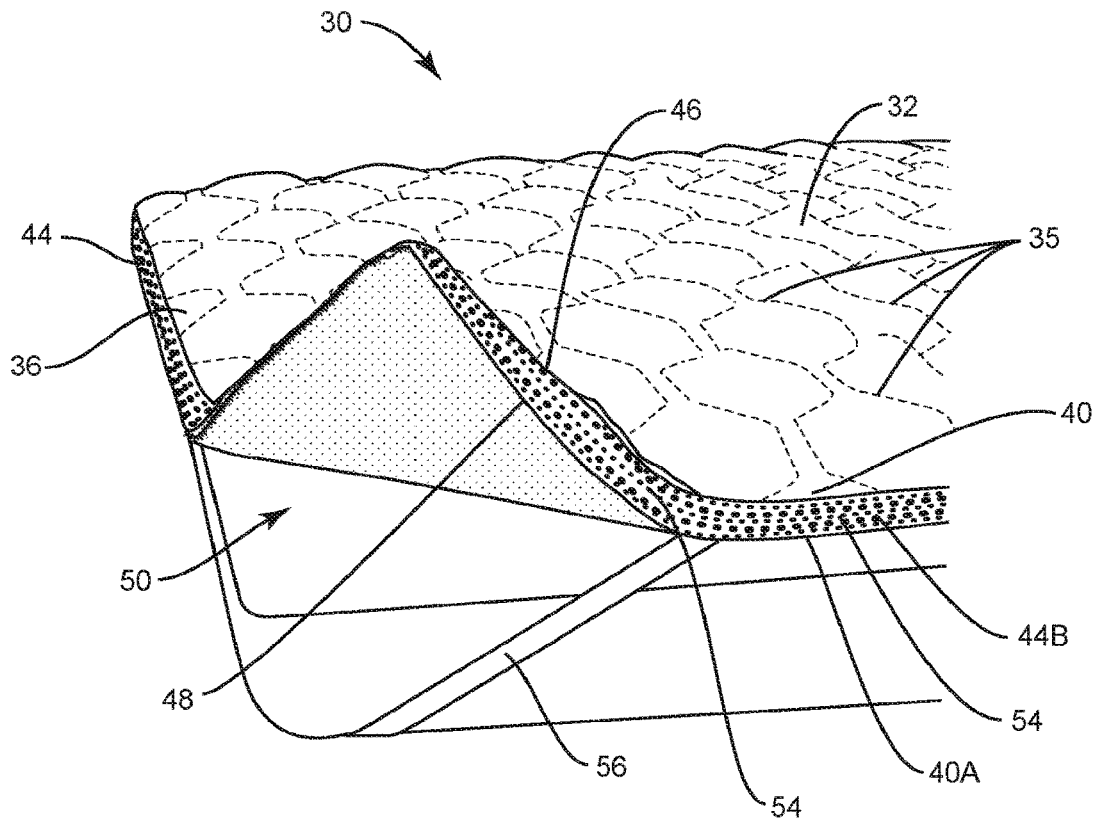
FIG. 3 is a perspective view of the mattress topper shown in FIG. 1, with parts separated.

Mattress topper 30 includes a gusset 44 that joins panel 32 with panel 32A. Gusset 44 is made from a second material that is different from the first material that panels 32, 32A are made from. Gusset 44 comprises a surface or edge 46 and a surface or edge 48 opposite surface 46. In some embodiments, gusset 44 has a height defined by the distance between surfaces 46, 48. In some embodiments, the height of gusset 44 is between about 0.25 inches and about 5 inches. In some embodiments, the height of gusset 44 is about 1.5 inches. In some embodiments, surface 46 engages surfaces 34, 36, 38, 40 and surface 48 engages surfaces 34A, 36A, 38A, 40A such that gusset 44 perimetrically bounds and joins panels 32, 32A, as shown in FIGS. 1-3, for example. That is, surface 46 continuously engages surfaces 34, 36, 38, 40 such that there are no gaps between surface 46 and surfaces 34, 36, 38, 40 and surface 48 continuously engages surfaces 34A, 36A, 38A, 40A such that there are no gaps between surface 48 and surfaces 34A, 36A, 38A, 40A. Gusset 44 separates panel 32 from panel 32A and allows air that enters an interior cavity 50 of mattress topper 30 through at least one of panels 32, 32A, for example, to exit cavity 50 through gusset 44.

Moreover, it is envisioned that in embodiments wherein panel 32 includes one or a plurality of the channels discussed above (e.g., the channels formed by lines LN1 and LN2 of stitching 35 shown in FIG. 7), heated air may enter the channels through the top layer of panel 32 and exit mattress topper 30 through gusset 44. That is, heated air within each of the channels can exit each of the channels through openings at either end of each channel that extend through surfaces 38, 40 and then exit mattress topper 30 through gusset 44. This configuration allow for continuous air flow through panel 32. That is, ambient air and/or air from a sleeper's body is permitted to move continuously from the sleeper or area surrounding mattress topper 30, into the channels in panel 32 and out of mattress topper 30 through gusset 44, since the channels are in communication with gusset 44. In that cavity 50 is also in communication with gusset 44, air from the sleeper's body that moves through panel 32 and into cavity 50 (e.g., through the lower layer of panel 32) will move continuously through cavity 50 such that the air will exit mattress topper 30 through gusset 44. Panel 32 may have at least one stylized gusset in the form of patches, conjoined patches, and/or various geometrically shaped gussets in addition to the perimetrically bounding gusset or instead of the perimetrically bounding gusset to facilitate continuous air flow through panel 32.

In some embodiments, gusset 44 is a continuous band. In some embodiments, gusset 44 comprises a longitudinal portion 44A between surfaces 38, 38A (FIGS. 1 and 2) and a longitudinal portion 44B between surfaces 40, 40A (FIG. 3). Portion 44A is positioned opposite portion 44B. In some embodiments, gusset 44 comprises a lateral portion 44C between surfaces 34, 34A (FIG. 4) and a longitudinal portion 44D between surfaces 36, 36A (FIG. 1). Portion 44C is positioned opposite portion 44D. In some embodiments, portions 44A-D are each separate from one another and are connected to one another by stitching, for example. In some embodiments, portions 44A-D are continuous. In some embodiments, longitudinal portion 44A may be disposed at alternate orientations relative to longitudinal portion 44B, such as, for example, parallel, transverse, perpendicular and/or other angular orientations such as acute or obtuse, tapered, and/or may be offset or staggered. Likewise, in some embodiments, lateral portion 44C may be disposed at alternate orientations relative to lateral portion 44D, such as, for example, parallel, transverse, perpendicular and/or other angular orientations such as acute or obtuse, tapered, and/or may be offset or staggered.

In some embodiments, a reinforcing material, such as, for example, piping or cording 52 is used to join surface 46 with surfaces 34, 36, 38, 40 and/or surface 48 with surfaces 34A, 36A, 38A, 40A. In some embodiments, cording 52 is a strip of fabric, such as, for example, folded fabric that is inserted between surfaces 34, 36, 38, 40 and surface 46 and/or between surfaces 34A, 36A, 38A, 40A and surface 48 to define edges of mattress topper 30. In some embodiments, mattress topper 30 includes a first piece of cording 52 that joins join surface 46 with surfaces 34, 36, 38, 40 and a second piece of cording 52 that joins 34A, 36A, 38A, 40A and surface 48. The first piece of cording 52 is spaced apart from the second piece of cording by gusset 44. In some embodiments, cording 52 comprises a material that is different from the first material and/or the second material. In some embodiments, cording 52 comprises a material that is more rigid and/or less flexible than the first material and/or the second material. In some embodiments, cording 52 comprises a material that is non-porous.

As discussed above, panels 32, 32A are made from the first material and gusset 44 is made from the second material that is different from the first material. In some embodiments, the second material has a porosity that is greater than that of the first material. In some embodiments, the second material has a porosity that is less than that of the first material. In some embodiments, the second material comprises a mesh material. In some embodiments, the second material comprises an inner layer and an outer mesh layer. In some embodiments, the inner layer is a filter fabric that reduces passage of loose fibers or other small objects, including allergens such as dust and pet dander from the environment, into mattress topper 30, while still allowing air flow through gusset 44. In some embodiments, the inner layer comprises cushioning material. In some embodiments, the second material comprises a breathable material, such as, for example a breathable fabric. In some embodiments, the second material comprises a stretchable and/or elastic material. In some embodiments, the second material comprises polyester, spandex, a polyester/spandex blend, 100% polyester knit, natural materials (hemp), 100% natural fabrics or natural fabrics blended with elastic fibers or waterproof fabrications. In some embodiments, the second material is a porous sheet of material, such as, for example, fabric having a porosity that is substantially greater than (e.g., at least twice) the porosity of the first material. In some embodiments, the second material is porous and has a porosity that is greater than the porosity of the second material.

In some embodiments, the pores of the second material are defined by fibers or strands of the second material to provide gusset 44 with a porosity that is greater than the porosities of the first material. That is, the pores the second material are defined by the space between fibers or strands of the second material. It is envisioned that gusset 44 may be made of any material that increases the dissipation of body heat from the sleeper's body by transferring the body heat from within cavity 50 to a location outside of mattress topper 30 and/or from within the channels defined by adjacent lines LN1 and LN2 of stitching 35 to a location outside of mattress topper 30. For example, the second material comprises a material that allows heat that enters cavity 50 through at least one of panels 32, 32A to escape cavity 50 through gusset 44 and/or a material that allows heat that enters the channels defined by adjacent lines LN1 and LN2 of stitching 35 to escape the channels through gusset 44. The second material also allows ambient air to enter cavity 50 through gusset 44 and/or the channels defined by adjacent lines LN1 and LN2 of stitching 35 through gusset 44. This configuration allows a cross-flow between heated air from the sleeper's body within cavity 50 and ambient air outside of mattress topper 30. This configuration may also allow for a cross-flow between heated air from the sleeper's body within the channels defined by adjacent lines LN1 and LN2 of stitching 35 and ambient air outside of mattress topper 30, thus allowing for improved temperature regulation and a cooler core to the sleep surface and/or mattress topper 30.

In some embodiments, gusset 44 comprises apertures 54 formed in the second material, as shown in FIGS. 1-3, 10 and 11, for example. In some embodiments, apertures 54 are cut or otherwise formed in the second material to provide gusset with a porosity that is greater than the porosities of the first material. In some embodiments, the second material comprises a porous material having apertures 54 cut or punched into the second material during the manufacturing process to provide the second material with a porosity that is greater than the porosity of the first material. In some embodiments, apertures 54 extend through fibers or strands that make up the second material. That is, apertures 54 each separate at least one of the fibers that make up the second material into two distinct portions that are separated by one of apertures 54.

In some embodiments, apertures 54 extend through opposite inner and outer surfaces of gusset 44. In some embodiments, apertures 54 extend through the outer surface of gusset 44 without extending through the inner surface of gusset 44. In some embodiments, apertures 54 extend through the inner surface of gusset 44 without extending through the outer surface of gusset 44. In one embodiment, the second material has a porosity that is created by pores that are defined by fibers or strands of the second material and apertures 54 to provide gusset 44 with a porosity that is greater than the porosity of the second material.

Figure 10:
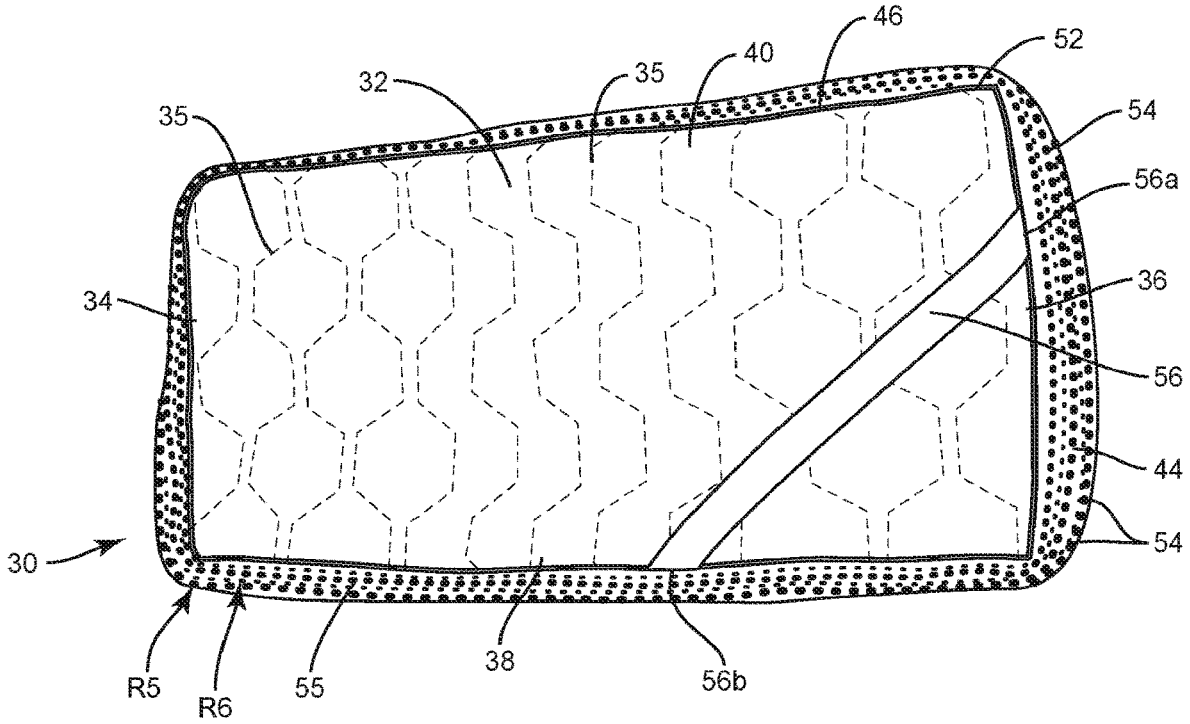
FIG. 10 is a top view of one embodiment of the mattress topper shown in FIG. 1.
Figure 11:
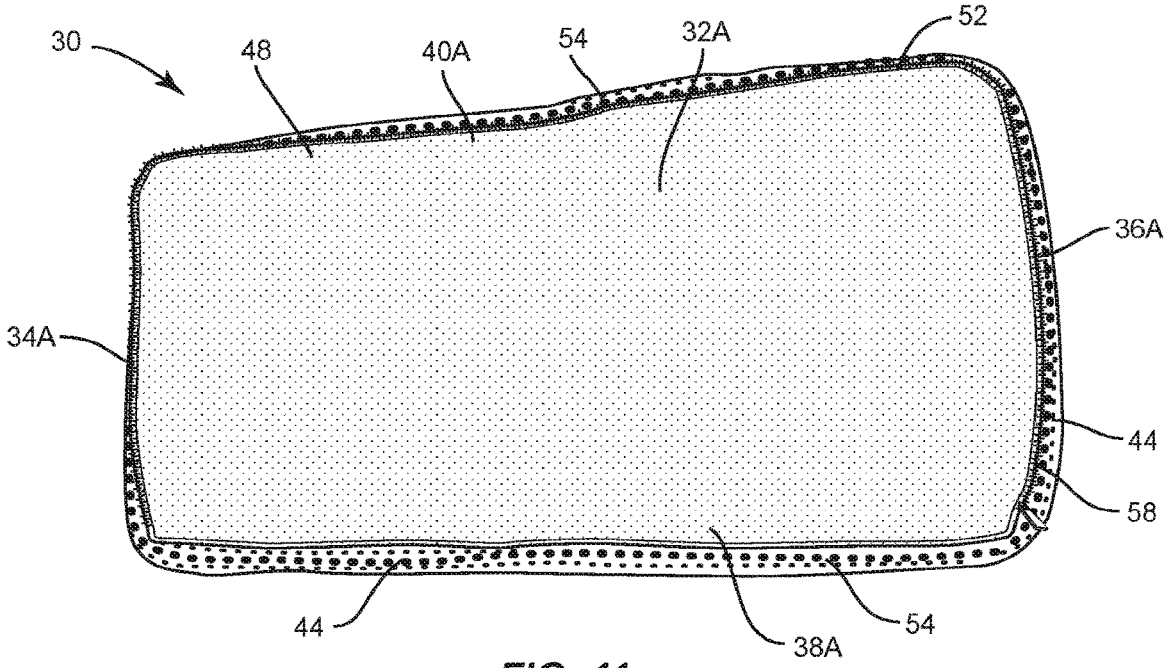
FIG. 11 is a bottom view of the mattress topper shown in FIG. 10.

In some embodiments, apertures 54 may have various cross section configurations, such as, for example, oval, oblong, triangular, rectangular, square, polygonal, irregular, uniform, non-uniform, variable, tubular and/or tapered. In some embodiments, apertures 54 are distributed uniformly along gusset 44. In some embodiments, apertures 54 are uniformly spaced apart from one another. In some embodiments, apertures 54 are randomly dispersed along gusset 44. In some embodiments, gusset comprises a plurality of rows of apertures 54, such as for example a plurality of rows R5 that are each adjacent another row R6 of apertures 54, as shown in FIGS. 2 and 10, for example. In some embodiments, apertures 54 in rows R5 have a size that is different than apertures 54 in an adjacent row R6. For example, in some embodiments, the rows of apertures 54 alternate between rows R5 having apertures 54 with a first size and rows R 6 having apertures 54 with a second size, wherein the first size is different than the second size. In some embodiments, the first size is greater than the second size, as shown in FIGS. 2 and 10, for example.

In some embodiments, gusset 44 comprises an anchor band that extends about a perimeter of gusset 44. In some embodiments, the anchor band is attached or otherwise coupled to an inner surface of the second material that defines a portion of cavity 50. In some embodiments, the anchor band is attached or otherwise coupled to an outer surface of the second material that is opposite the inner surface of the first material that defines a portion of cavity 50. In some embodiments, the anchor band comprises an elastic material, such as, for example, polyester and/or rubber.

Figure 6:
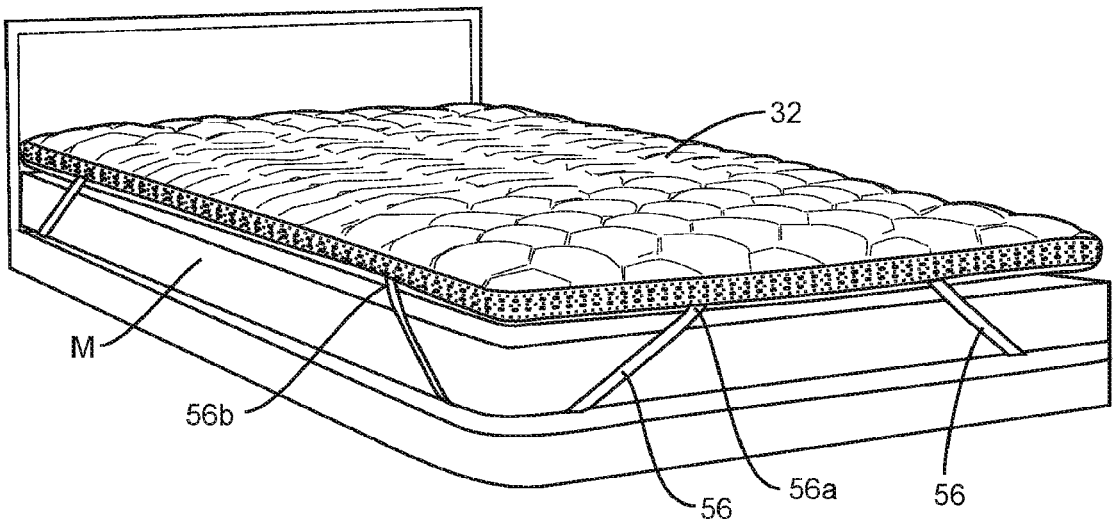
FIG. 6 is a perspective view of the mattress topper shown in FIG. 1, with the mattress topper positioned on top of a mattress.
Figure 9:
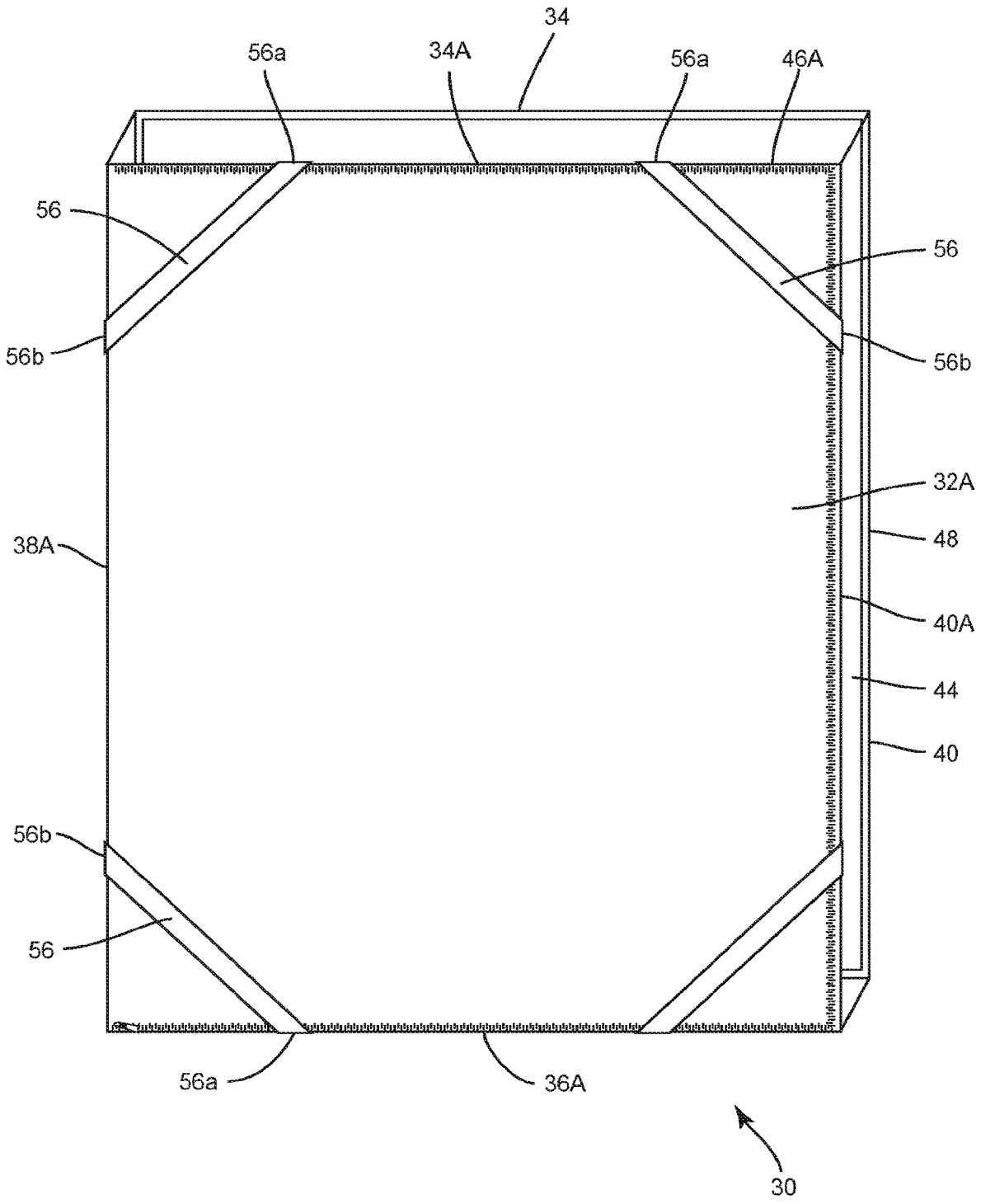
FIG. 9 is a bottom, perspective view of one embodiment of the mattress topper shown in FIG. 1.

In some embodiments, mattress topper 30 comprises an anchor band, such as, for example, anchor band 56. In some embodiments, anchor band 56 comprises a first end 56*a* that is coupled to mattress topper 30 between surface 34A and gusset 44 and an opposite second end 56*b* that is coupled to mattress topper 30 between surface 40A and gusset 40, as shown in FIG. 9, for example. In some embodiments, anchor band 56 is configured to be positioned under a corner of a mattress, such as, for example, mattress M, shown in FIG. 6. In some embodiments, each corner of mattress topper 30 includes an anchor band 56. In some embodiments mattress topper 30 includes an anchor band 56 having a first end 56*a* that is coupled or attached to mattress topper 30 between surface 34A and gusset 44 and an opposite second end 56*b* that is coupled to mattress topper 30 between surface 38A and gusset 44. The first end 56*a* may also be coupled or attached to mattress topper 30 between surface 36A and gusset 44 and opposite second end 56*b* may also be attached or coupled to mattress topper 30 between surface 38A and gusset 44. The opposite second end 56*b* of anchor band 56 may be attached or coupled to mattress topper 30 between surface 40A and gusset 44, as shown in FIG. 9. As such, anchor bands 56 may each be positioned under one of the corners of mattress M to secure mattress topper 30 to mattress M, as shown in FIG. 6. In some embodiments, at least one of anchor bands 56 comprises an elastic material, such as, for example, polyester and/or rubber. In some embodiments, anchor bands 56 are attached to panel 32A and gusset 44 by positioning anchor bands 56 at a seam between panel 32A and gusset 44. In some embodiments, anchor bands 56 are attached to panel 32A and gusset 44 by sewing anchor bands 56 directly into a seam between panel 32A and gusset 44.

Figure 4:
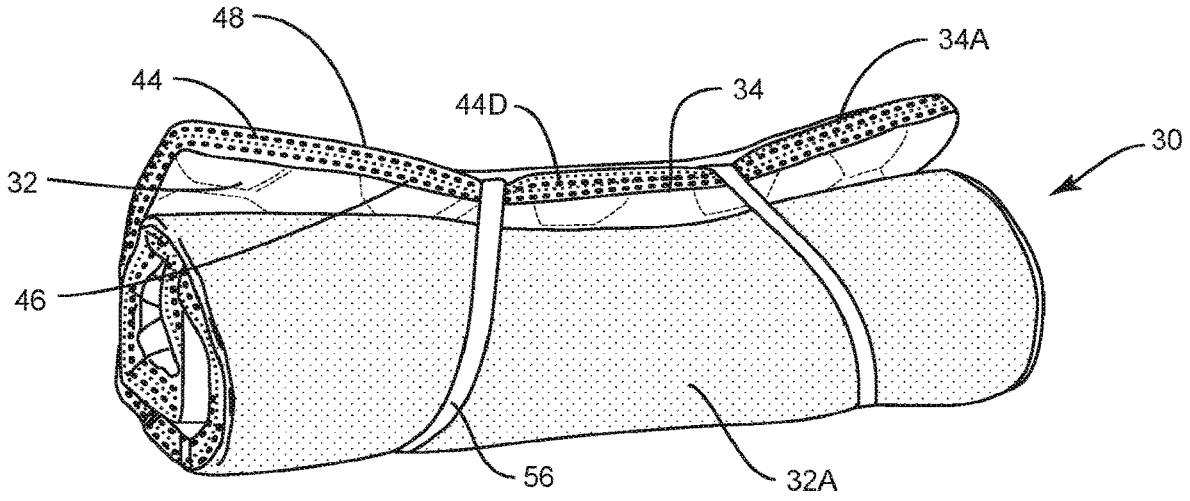
FIG. 4 is a side view of the mattress topper shown in FIG. 1, with the mattress topper in a rolled state for shipping and/or storage.
Figure 5:
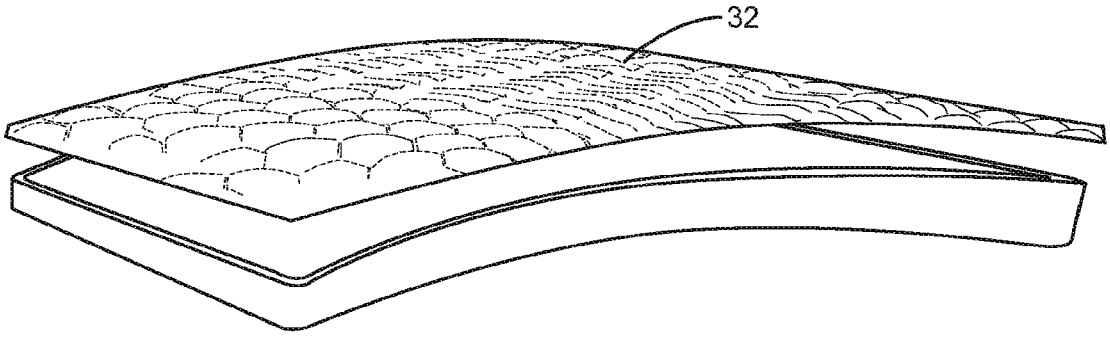
FIG. 5 is a perspective view of the mattress topper shown in FIG. 1, with parts separated.

In some embodiments, anchor bands 56 are attached to panel 32A and gusset 44 by stitching a box into panel 32A and/or gusset 44 at ends 56*a*, 56*b* of anchor bands, wherein the stitching resembles a square box that then possesses an "X" shape within it. In this configuration, each final point on the radius of the "X" shape touches one respective interior corner of the square so that all four corners are connect to each other across the interior span of the square. This evenly distributes any pulling pressure from any tension on any of anchor bands 56 in all directions and across mattress topper 30. That is, it reduces or removes pressure from the seam between panel 32A and gusset 44, thus reducing the likelihood of tearing mattress topper 30, and increasing overall grip, stability and durability of anchor bands 56. It is envisioned that at least one of anchor bands 56 may be positioned between panel 32 and gusset 44 such that a first end of at least one of anchor bands 56 is positioned between one of surfaces 34, 36, 38, 40 and surface 46 of gusset 44 and an opposite second end of at least one of anchor bands 36 is positioned between another one of surfaces 34, 36, 38, 40 and surface 46 of gusset 44. In some embodiments, one or more of anchor bands 56 may be used to maintain mattress topper 30 in a rolled configuration for shipping and/or storage, as shown in FIG. 4.

Cavity 50 is configured for disposal of a fill material. In some embodiments, the fill material may any material that provides cushioning and/or support for a sleeper that rests on top of mattress topper 30. In some embodiments, the fill material comprises a compliant material. In some embodiments, the fill material comprises a non-compliant material. In some embodiments, the fill material comprises polyester fiber, wool, kapok, latex, foam, memory foam, feathers, gel, memory foam and/or combinations or blends of the same. In some embodiments, the fill material comprises a single piece of foam. In some embodiments, the fill material may be multiple, separate or seamed pieces of foam, or separate or seamed chambered inserts containing various fill materials, or a combination thereof. In some embodiments, the fill material has an uncompressed volume that is greater than an unexpanded volume of cavity 50. Due to the material(s) from which panels 32, 32A and gusset 44 are made and the relative volumes of the fill material and cavity 50, cavity 50 may expand as the fill material is positioned in cavity 50. As cavity 50 expands, cavity 50 and/or mattress topper 30 assumes the general shape of the fill material. Due to the material(s) from which panels 32, 32A and gusset 44 are made and the relative volumes of the fill material and cavity 50, cavity 50 molds to conform with the outer dimensions of the fill material such that mattress topper 30 will have approximately the same shape as the fill material. In some embodiments, mattress topper 30 includes at least some air between panels 32, 32A and the fill material and/or between gusset 44 and the fill material.

In some embodiments, panels 32, 32A engage the fill material such that there is no air between panels 32, 32A and the fill material and gusset 44 engages the fill material such that there is no air between gusset 44 and the fill material. In some embodiments, the fill material is porous such that air in cavity 50 becomes trapped within the pores of the fill material. The air trapped within the pores of the fill material can exit mattress topper 30 through panels 32, 32A and/or gusset 44. In some embodiments, the fill material is removeably positioned within cavity 50. In some embodiments, the fill material is secured within cavity 50 by stitching or some other means that fixes the fill material to one of panels 32, 32A and gusset 44.

Figure 13:
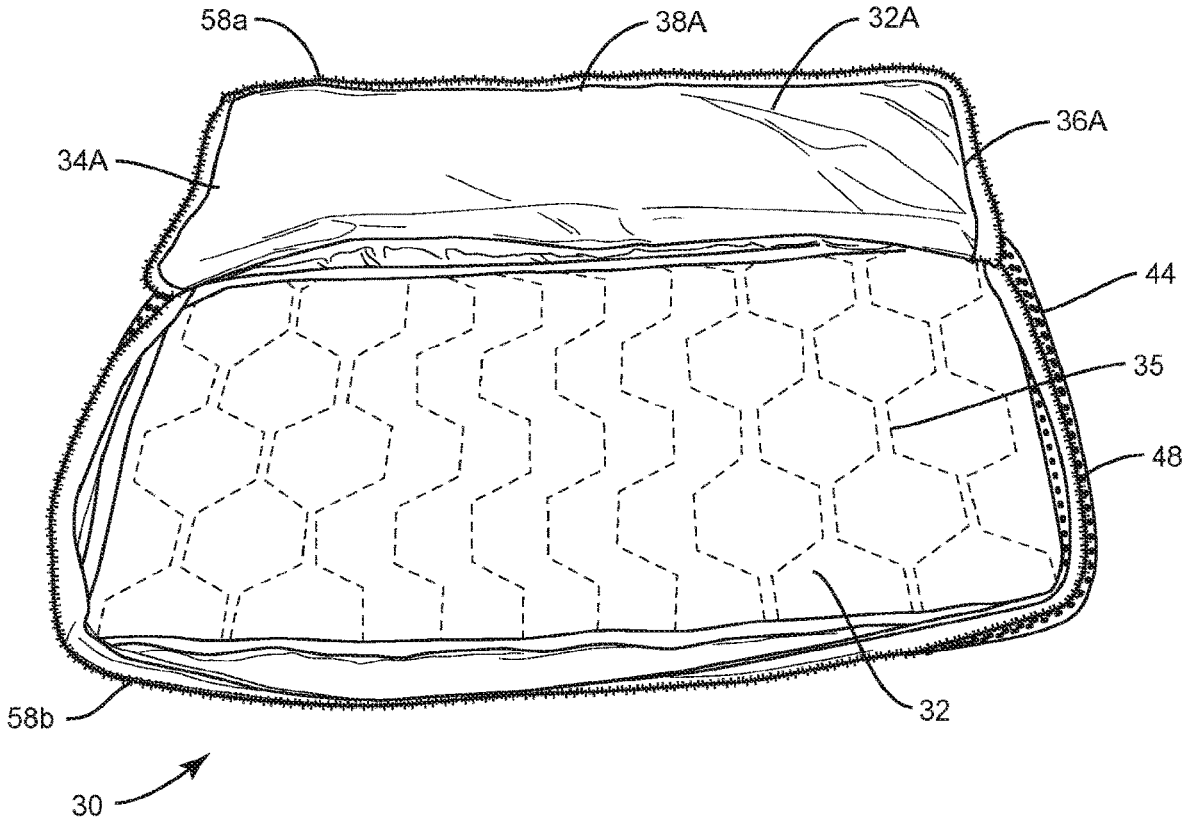
FIG. 13 is a bottom, perspective view of the mattress topper shown in FIG. 10.

In some embodiments, panel 32A comprises a first portion of a fastener, such as, for example, a zipper 58 (FIG. 11), and surface 48 of gusset 44 comprises a second portion of a fastener, such as, for example, zipper 58. As shown in FIG. 13, panel 32A comprise a first set of teeth 58*a* of zipper 58. Teeth 58*a* extend along surfaces 34A, 36A, 38A. Teeth 58*a* do not extend along any portion of surface 40, as shown in FIG. 13. Rather, surface 40A is permanently attached to surface 46 of gusset 44. Gusset 44 comprises a second set of teeth 58*b* of zipper 58. Teeth 58*b* extend along surfaces 48, as shown in FIG. 13. This provides zipper 58 with a substantially "U" shape that extends along both short sides of mattress topper 30 (e.g., the side defined by surfaces 34, 34A and the side defined by surfaces 36, 36A) and one long side of mattress topper 30 (e.g., the side defined by surfaces 38, 38A). Zipper 58 is configured to move from a closed position, shown in FIG. 11, in which teeth 58*a* engage teeth 58*b* and there is no access to cavity 50, to an open position, shown in FIG. 13, in which teeth 58*a* are spaced apart from teeth 58*b* to provide access to cavity 50. In some embodiments, teeth 58*a* are sewn to surfaces 34A, 36A, 38A and teeth 58*b* are sewn to surface 48. This configuration allows gusset 44 to be exposed when zipper 58 is in the open configuration to allow for increased ventilation and also results in increased insulation when zipper 58 is in the closed configuration.

In some embodiments, mattress topper 30 may include a heating and/or cooling element within cavity 50 to allow a sleeper to match the temperature of cavity 50 according to his or her sleep preference. For example, the sleeper can set the heating and/or cooling element to regulate the temperature within cavity 50 to a desired temperature such that if the temperature within cavity 50 deviates from the set temperature, the heating and/or cooling element will increase or decrease the temperature within cavity 50. In some embodiments, the heating and/or cooling element is a thermoelectric device that is capable of heating and cooling air.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bed covering comprising:

a cover, the cover including joined first and second panels, at least one of the panels comprising a first layer, a second layer and a third layer, the third layers defining an inner cavity, the first layers defining an outermost surface of the cover, the second panel including a zipper; and an anchor band coupled to the zipper by reinforced stitching, wherein the first layers each comprise a first material, the second layers each comprise a second material and the third layers each comprise a third material, the first material being different from the second material and the third material and the second material being different from the first material and the third material, and wherein the anchor band comprises a first anchor band, a second anchor band, a third anchor band and a fourth anchor band, the anchor bands each including opposite first and second ends, the first and second ends of the first and second anchor bands each being coupled to the zipper, the first ends of the third and fourth anchor bands each being coupled to the zipper, the second ends of the third and fourth anchor bands not being coupled to the zipper.

2. The bed covering recited in claim 1, wherein the first material is a heat and moisture wicking fabric, the second material is a filter fabric and the third material is a cushioning material.

3. The bed covering recited in claim 2, wherein the second material is configured to reduce movement of particles through the panels and into the inner cavity.

4. The bed covering recited in claim 1, wherein the first material is a fabric having a cool touch feel, the second material is a filter fabric and the third material is a cushioning material.

5. The bed covering recited in claim 1, wherein the first material is a fabric having a warm touch feel, the second material is a filter fabric and the third material is a cushioning material.

6. The bed covering recited in claim 1, wherein the first material is a moisture dispersing material, the second material is a filter fabric and the third material is a cushioning material.

7. The bed covering recited in claim 1, wherein the first material is a breathable material, the second material is a filter fabric and the third material is a cushioning material.

8. The bed covering recited in claim 1, wherein the first material is a waterproof material, the second material is a filter fabric and the third material is a cushioning material.

9. The bed covering recited in claim 1, wherein the second material is a filter fabric, the third material is a cushioning material and the first material is selected from the group consisting of polyester, 100% polyester, polyester and polyethylene, nylon, acrylic, acetate, cotton, linen, silk, polyester, wool, nylon, rayon, spandex, lycra, hemp, and blends thereof.

10. The bed covering recited in claim 1, wherein a waterproof finish is applied to at least one of the first layers.

11. The bed covering recited in claim 1, further comprising a temperature-adjustment material applied to at least one of the third layers.

12. The bed covering recited in claim 11, wherein the temperature-adjustment material is a gel.

13. The bed covering recited in claim 11, wherein the temperature-adjustment material is neoprene.

14. The bed covering recited in claim 1, further comprising a thermo-electric device positioned in the inner cavity, the thermo-electric device being configured to heat and cool the inner cavity.

15. The bed covering recited in claim 1, wherein the first panel has a porosity that is different than a porosity of the second panel.

16. The bed covering recited in claim 1, wherein the anchor band comprises an elastic material.

17. A bed covering comprising a cover including joined first and second panels, at least one of the panels comprising a first layer, a second layer and a third layer, the first layers defining an outermost surface of the cover, the third layers defining an inner cavity, the second panel including a zipper;

a temperature-adjustment material applied to at least one of the third layers;

an anchor band coupled to the cover by reinforced stitching, the anchor band comprising an elastic material; and fill material disposed within the inner cavity, wherein the first layers each comprise a first material, the second layers each comprise a second material and the third layers each comprise a third material, the first material being different from the second material and the third material and the second material being different from the first material and the third material, wherein the first material is a heat and moisture wicking fabric, the second material is a filter fabric and the third material is a cushioning material, and wherein the anchor band comprises a first anchor band, a second anchor band, a third anchor band and a fourth anchor band, the anchor bands each including opposite first and second ends, the first and second ends of the first and second anchor bands each being coupled to the zipper, the first ends of the third and fourth anchor bands each being coupled to the zipper, the second ends of the third and fourth anchor bands not being coupled to the zipper.

18. A bed covering comprising a cover including joined first and second panels, the second panel comprising a zipper, at least one of the panels comprising a first layer, a second layer and a third layer, the first layers defining an outermost surface of the cover, the third layers defining an inner cavity;

a temperature-adjustment material applied to at least one of the third layers;

an anchor band coupled to the zipper by reinforced stitching, the anchor band comprising an elastic material; and fill material disposed within the inner cavity, wherein the first layers each comprise a first material, the second layers each comprise a second material and the third layers each comprise a third material, the first material being different from the second material and the third material and the second material being different from the first material and the third material, wherein the first material is a heat and moisture wicking fabric, the second material is a filter fabric and the third material is a cushioning material, and wherein the anchor band comprises a first anchor band, a second anchor band, a third anchor band and a fourth anchor band, the anchor bands each including opposite first and second ends, the first and second ends of the first and second anchor bands each being coupled to the zipper, the first ends of the third and fourth anchor bands each being coupled to the zipper, the second ends of the third and fourth anchor bands not being coupled to the zipper.

* * * * *